United States Patent [19]

Chicharro

[11] Patent Number: 4,881,384

[45] Date of Patent: Nov. 21, 1989

[54] HIGH TEMPERATURE DYEING APPARATUS

[75] Inventor: Mario M. Chicharro, Martorell, Spain

[73] Assignee: Montaje Y. Construcciones Del Hierro, S.A., Barcelona, Spain

[21] Appl. No.: 216,274

[22] Filed: Jul. 8, 1988

[30] Foreign Application Priority Data

Apr. 22, 1988 [ES] Spain ..... 8801372

[51] Int. Cl.[4] ..... D06B 3/28

[52] U.S. Cl. ..... 68/27; 68/62; 68/178; 226/193

[58] Field of Search ..... 68/62, 27, 177, 178; 226/190, 191, 193

[56] References Cited

U.S. PATENT DOCUMENTS

| | | | |
|---|---|---|---|
| 2,561,761 | 7/1951 | Tempe | 226/190 X |
| 2,793,034 | 5/1957 | McKee | 68/177 X |
| 4,142,385 | 3/1979 | Sandberg et al. | 68/178 |
| 4,143,527 | 3/1979 | Trullas | 68/178 X |
| 4,489,575 | 12/1984 | Arashi | 68/177 |

FOREIGN PATENT DOCUMENTS

| | | | |
|---|---|---|---|
| 1916724 | 2/1970 | Fed. Rep. of Germany | 68/177 |
| 3544860 | 1/1987 | Fed. Rep. of Germany | 68/177 |
| 1588943 | 3/1970 | France | 68/177 |
| 274703 | 7/1927 | United Kingdom | 68/177 |
| 2078803 | 1/1982 | United Kingdom | 68/177 |

*Primary Examiner*—Philip R. Coe

*Attorney, Agent, or Firm*—Fleit, Jacobson, Cohn, Price, Holman & Stern

[57] ABSTRACT

A high temperature dyeing apparatus of the type operating in an open chamber on an endless rope of fabric to be dyed, the rope being drawn by mechanical and hydraulic devices, wherein within a cylindrical body (4) having curved end walls (4*a*) there is disposed an even number of open treatment and storage chambers (25), cylindrical body (4) having at the top thereof in one of its upper sectors a cylindrical turret (26). In the interior of turret (26) is mounted horizontally a drive winch (2) having a cylindrical core (38) and two circular flanges (39) between which are disposed pairs of rods (34) covered on the upper side with a nonslip material (34*a*) having a knurled configuration.

Inside turret (26) below winch (2) is provided a low pressure jet (22) inside a closed cavity (35) comprised by two spaced truncated cones (36), (37) and flow divider walls or thereon.

12 Claims, 6 Drawing Sheets

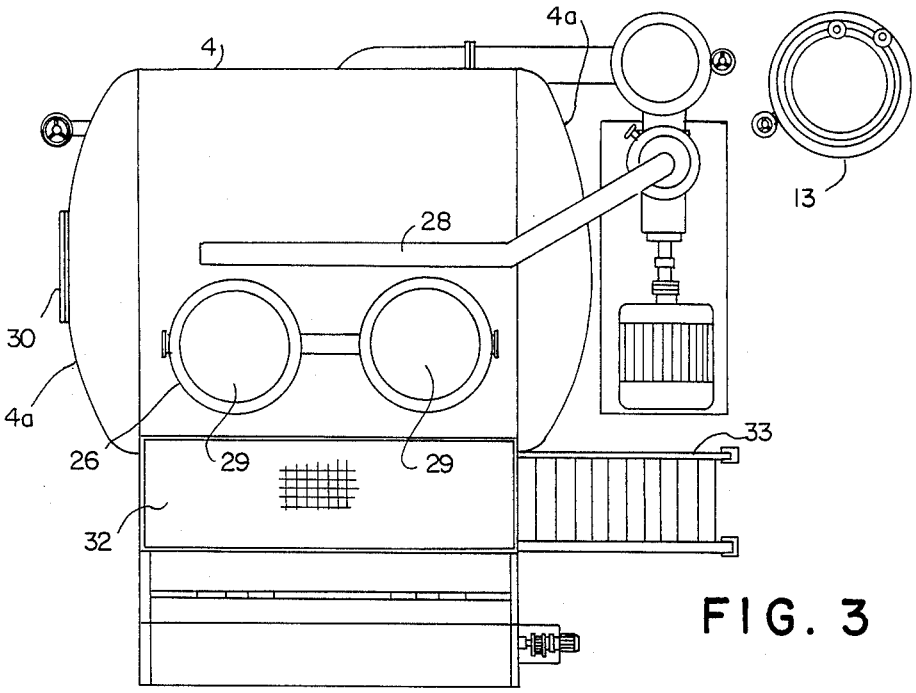
FIG. 3
FIG. 5
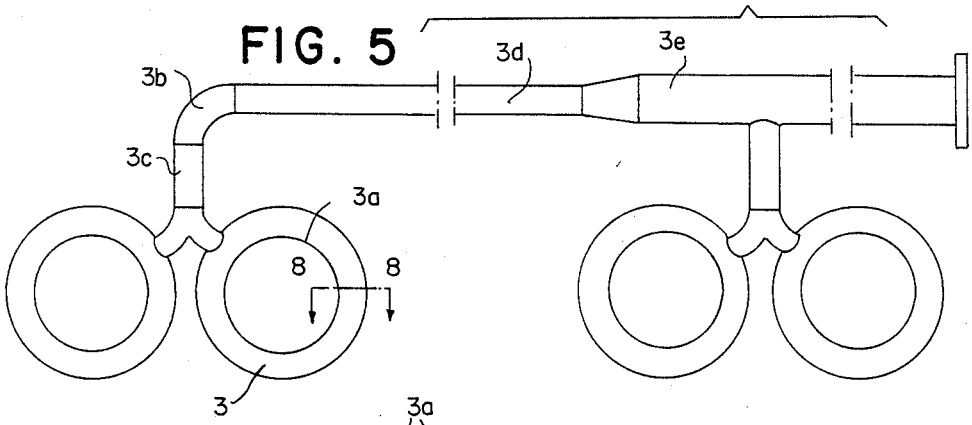
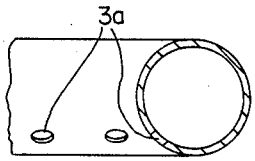
FIG. 8

HIGH TEMPERATURE DYEING APPARATUS

BACKGROUND OF THE INVENTION

1. Field of The Invention

The present invention relates to improvements in high temperature dyeing apparatus, and more particularly to new constructional, shape and design features thereof of which fulfill the requirements for high temperature dyeing with maximum reliability and efficiency.

2. Description Of The Prior Art

A plurality of high temperature dyeing apparatus are presently on the market of which, the majority according to technology of public common knowledge, are characterized by having an enclosed area. A fabric is drawn in endless rope form through the interior of said the enclosed area by a drive winch and by the force of the dye liquor itself, using certain hydraulic means, the enclosed area forming a volume in which the fabric receives the dye treatment.

The treatment chamber forming part of the enclosed area is constituted in the majority of cases, in high temperature dyeing apparatus, by a substantially cylindrical central horizontal tubular body containing up to a certain level a mixture of water with the corresponding dyestuffs, always depending on color selected for dyeing the fabric to be treated in the apparatus.

In turn the chambers have on their surface a plurality of orifices through which the dye liquor may flow freely pumped by conventional pumps and regulated by conventional valves, all of this allowing both the dye liquor speed and pressure on the fabric to be dyed to be controlled.

For drawing the fabric in rope form, the known apparatus on the market are provided in general with a winch contained in a normally cylindrical upper body located above the treatment chamber, which winch is driven by a variable speed electric motor, the winch supporting the fabric or rope for insertion in a transport duct in which there is an overflow which, together with a jet, located downstream of the overflow, form a combination for driving the rope inside the storage chamber.

This arrangement, due mainly to the great length of the treatment chamber, is the fundamental reason why the known apparatus have an excessively long fabric treatment time as a result of the long path which the rope must traverse both on the outward run and on the inward run several times. All of this represents furthermore an excessive expense in energy, which is used both in drawing the fabric and in the need to provide a flow rate at a preset pressure to the overflow and also to the jet for such a long run of the fabric to be treated.

To the above drawbacks should be added that the excessive volume of the chambers of the apparatus affects the power required to raise the temperature of the mass of water, as well as the electric power required for pumping the whole volume of liquor contained therein throughout the apparatus. The very large volume is also a drawback when it is necessary to cool the liquor, considering particularly that all of these apparatus work at an approximate maximum temperature of 135° C., with an operating pressure of 3.5 kg/cm$^2$.

BRIEF SUMMARY OF THE INVENTION

An object of the present invention is to overcome the foregoing drawbacks by providing a smaller floor space occupied by the apparatus, whereby their use in new facilities today allows a larger number of apparatus to be installed in one same surface area.

A further object of the present invention is to increase the efficiency of the apparatus with respect to the quality of the dyeing operation performed thereby, and at the same time on the one hand, provide power savings in the electric motors required for normal operation, since the treatment chamber requires a smaller volume. Also, since a smaller amount of energy is applied from the outside in the form of steam to raise the temperature of the volume, a further reduction of consumption is achieved. In the same way also when cooling the liquor, the smaller volume of liquor to be treated will mean a shorter cooling time.

The reduction of the treatment chamber volume is achieved by using a substantially circumferencial shape of the chambers and arranging several chambers in parallel within the dyeing apparatus. The dyeing apparatus is of cylindrical construction and has the ends closed by respective end walls welded to the cylindrical construction. According to the user's needs, the cylindrical apparatus construction may be longer or shorter, at the same time as it may have a larger or smaller diameter, depending on the user's needs and on the nature of the fabrics. The elongation of the cylindrical construction will also imply an increase in the number of circumferential chambers existing therein. In all embodiments a compact symmetrical formation will be followed.

The cylindrical body containing the circumferential treatment chambers is supported on the floor by four legs. At the top of the cylindrical body there are one or more cylinders depending on the number of treatment chambers arranged in the interior thereof. The cylinders contain winders of original design described hereinafter and controlled by respective direct current motors. Enclosed departments for the first low pressure jet of the cylindrical bodies to the storage chambers are connected by a circular tube the end of which has a rectangular prismatic shape. This tube contains a second high pressure jet.

External auxiliary elements for the general operation of the apparatus include a main pump which aspirates the liquor contained in the treatment chamber through a tube connected to the main cylindrical body through a conventional filter.

The novelty of the inventive device resides basically, further to the arrangement and shape of the treatment chambers, in the geometry of the first low pressure jet inside an enclosed chamber, in combination with the shape of the treatment chamber, all aided with a ring shaped device which drives the dye treatment liquor on the rope reinforcing the contact between said liquor and said rope which has already occurred in the first low pressure jet and the second high pressure jet.

The efficiency of a dyeing apparatus resides basically in the number of contacts between the molecules of the dye liquor and those of the fabric to be dyed, and the greater the number is under certain temperature and pressure conditions, the greater will be the quality and efficiency of the process.

Other details and features of the present invention will be disclosed in the following description, with reference to the drawings accompanying the specification in which the preferred details are shown rather schematically. These details are given as an example, referring to one possible embodiment, but the invention is not limited to the details given herein; therefore this description should be considered from an illustrative point of view, without limitations of any kind.

BRIEF DESCRIPTION OF THE DRAWINGS

The invention will now be described in detail with reference to the accompanying drawing, wherein:

FIG. 3 is a top plan view of the present invention as shown in FIG. 1;

FIG. 5 is a top plan view of the fabric spray and guide ring 3, operatively located between the winch 2 and the exit of the storage or treatment chamber 25.

FIG. 8 is a cross sectional view of the ring 3 taken on the line 8—8 of FIG. 5;

DETAILED DESCRIPTION

Figure 1:
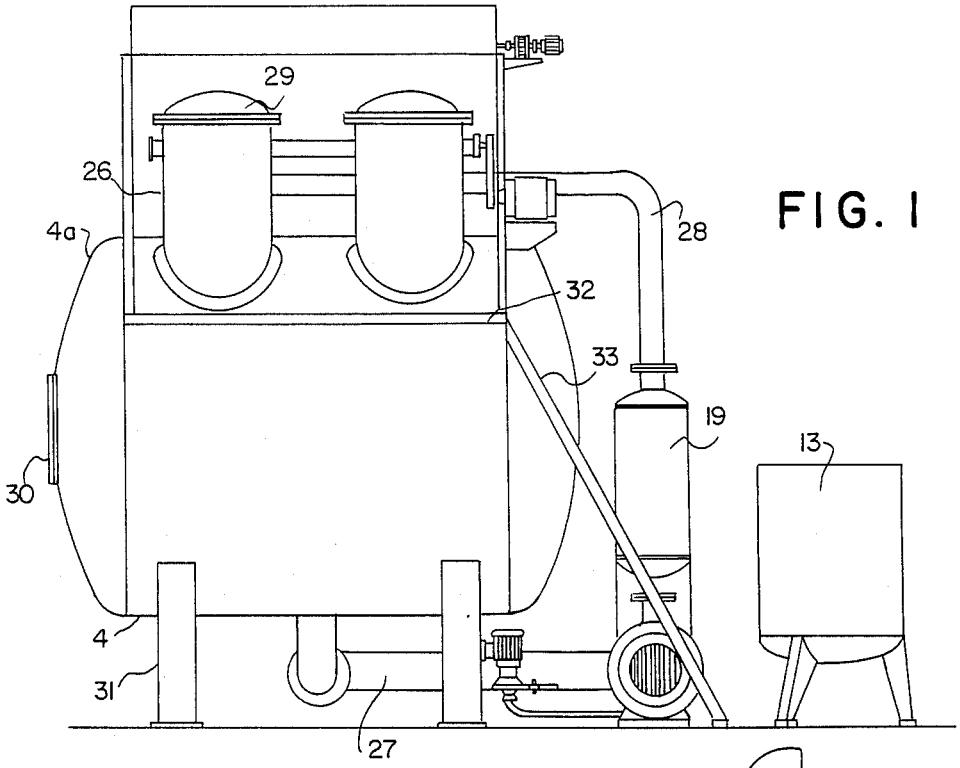
FIG. 1 is a side elevational view of the inventive apparatus complete with all the accessories required for its operation.
Figure 2:
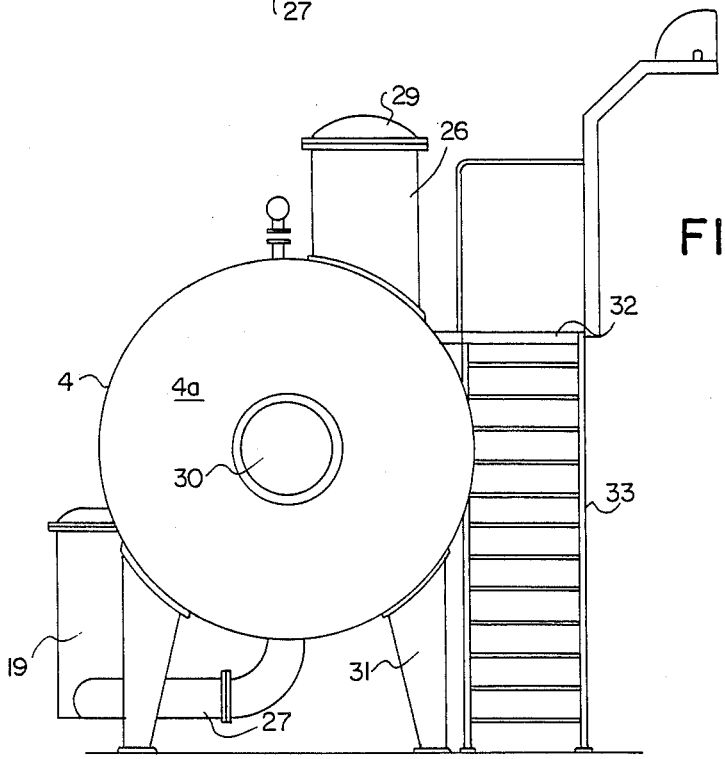
FIG. 2 is a rear elevational view in which the cylindrical body 4 may be seen to have at the top and towards one side the cylindrical turret 26 with the opening and closing means 29 thereof.
Figure 4:
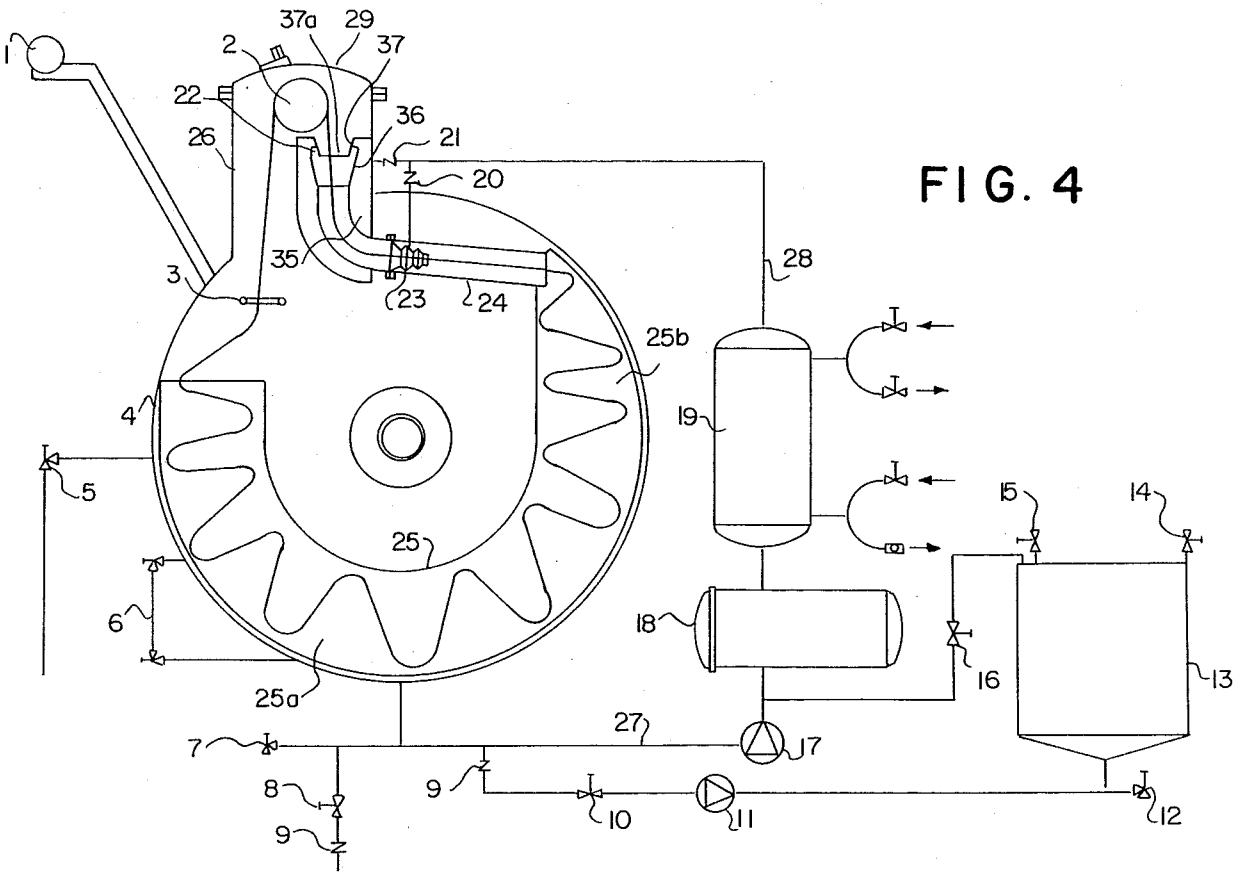
FIG. 4 is a vertical sectional view including a diagram showing the principle of operation of the apparatus with all its accessories.
Figure 6:
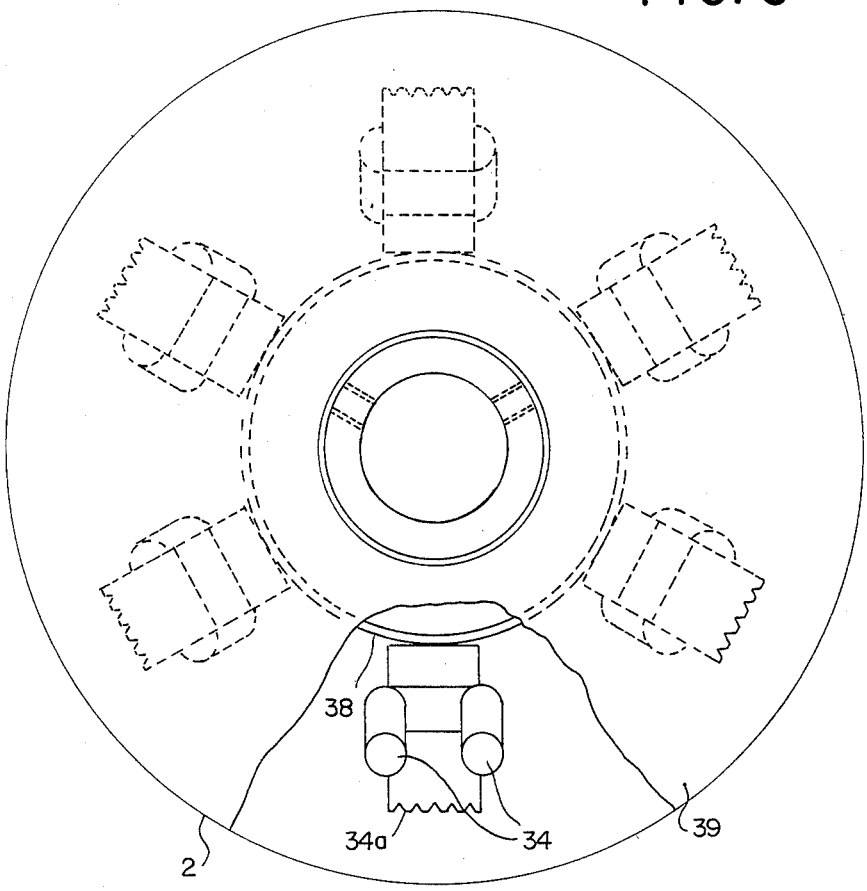
FIG. 6 is an end view of the winch with the end plate broken away to show the interior in part.
Figure 7:
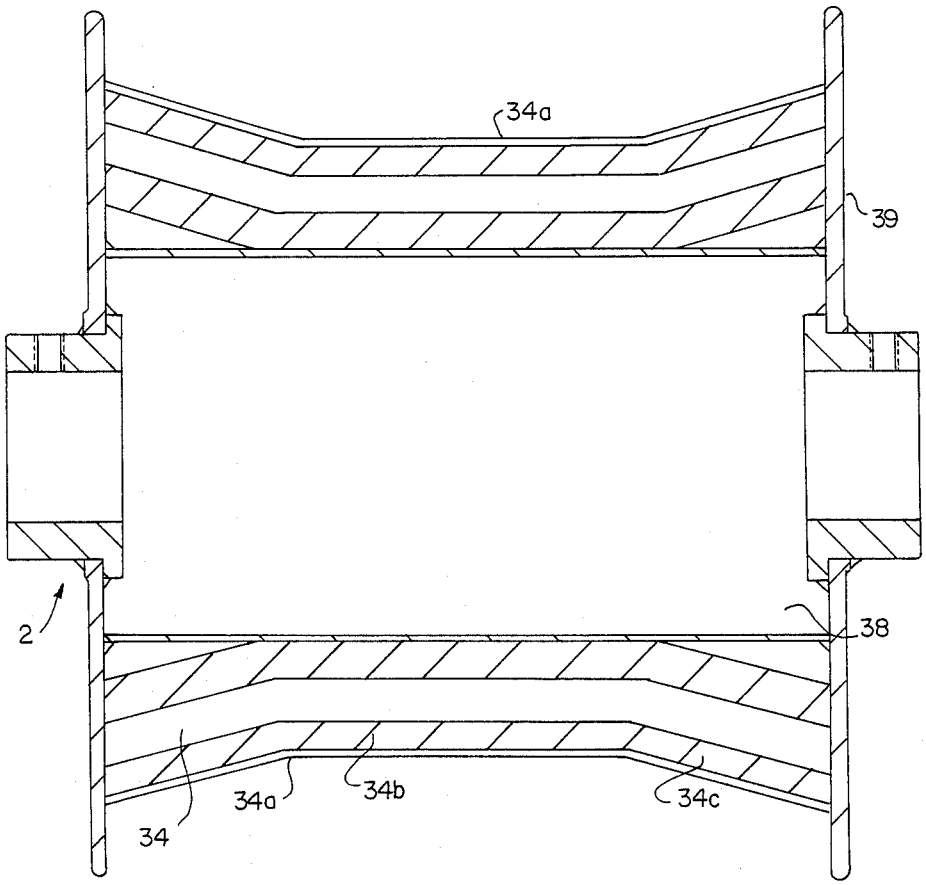
FIG. 7 is a longitudinal cross-sectional view of the winch in which there may be seen the strips or rods 34 with their peculiar shape welded to the flanges of the winch (2)

The device of this invention has in one of its preferred embodiments a cylindrical outer casing 4 which is closed at the ends by respective end walls **4*a*, forming a compact symmetrical arrangement. Cylindrical body 4 is supported on the floor by four legs 31. Inside cylindrical 4 (FIG. 4) there are situated in parallel an even number of storage and treatment chambers 25**, which are completely independent from each other.

Chambers 25 have a partially spiral shape with a first semicircular section **25*a*, extended at one end which is the inlet end by an almost straight vertical run 25*b*, the cross sectional area varying in area 25*b* and being constant in 25*a***.

At the top of the cylindrical body 4 there are located one or more cylinders 26, or cylindrical turrets, depending on the working volume and number of treatment chambers, in which are located the winches (2) driven by direct current motors (not shown) and the enclosed departments or closed chambers 35 of the first low pressure jet 22.

The last mentioned cylinders 26 and the storage and treatment chambers 25 are connected by a circular tube 24 which at the end thereof has a rectangular prismatic shape. A high pressure jet 23 is located in tube 24.

Outside the apparatus there is located the main pump 17 which aspirates the liquor in the body 4 through a tube 27 connected to the main cylindrical body 4 through a conventional filter 18. In the discharge phase of pump 17, the liquor flows through a cylindrical tube 28 which feeds the low pressure jet 22 and high pressure jet 23 from the outside of the apparatus through a heat exchanger 19 for heating or cooling the liquor.

There is also provided an inspection platform 32 from which the fabric loading and discharge operations are performed by way of a winder 1 which is driven by a geared motor (not shown). From platform 32 it is possible to observe inside the apparatus through sight glasses which are mounted in the lid or cover 29 and contain on the outside thereof powerful floodlights allowing the inside of the apparatus to be observed without having to open cover 29.

In one of the end walls of the main cylinder 4 there is manhole 20 which provides access to the inside of the apparatus and has a sight glass with its corresponding floodlight. Likewise, outside the apparatus there is the addition container 13 allowing liquor to be added to the apparatus by way of a small pump 11.

The special shape of the chambers 25 in the cylindrical body 4 allows the assembly of an even number thereof inside cylindrical body 4, all of them being independent and each supplied by winch 2, whereby a greater performance is attained since only one winch drive motor is required for each pair of chambers 25.

Winch 2 has some completely new features directed essentially to the fact that at a particular rpm winch 2 does not provide bows or deformations of the rope drawn by said winch. For this purpose winch 2 is provided with a cylindrical core 38 having two thin circular flanges 39 between which there are disposed a plurality of rods 34 covered on the outer surface thereof with a nonslip material **34*a* the surface of which is provided with a knurled configuration. The said rods 34 are attached at the ends thereof to the flanges 39, have a horizontal central portion 34*b* parallel to the axis of rotation of the winch 2 and respective end portions 34*c* inclined slightly radially outwardly. The configuration of the rods 34 in combination with the entry surface of the strips of nonslip material 34*a*, at the same time as they prevent the formation of knots and loops by slipping of the rope on the winch, as described above, always oblige the rope to work on the central portion of the winch, since this is on a lower plane than that of the ends of rods 34 thereby preventing the rope from overruning at any time the circular flanges 39** and becoming entangled on the rotating shaft on which the winch is mounted.

The drive force of winch 2, which should be considered as the mechanical drive means, is reinforced by the action of three hydraulic means to be described hereafter.

Figure 10:
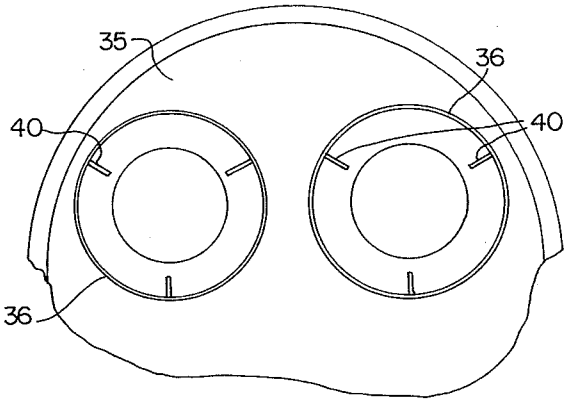
FIG. 10 is a top plan view of FIG. 9 with the inner part removed for clarity.
Figure 9:
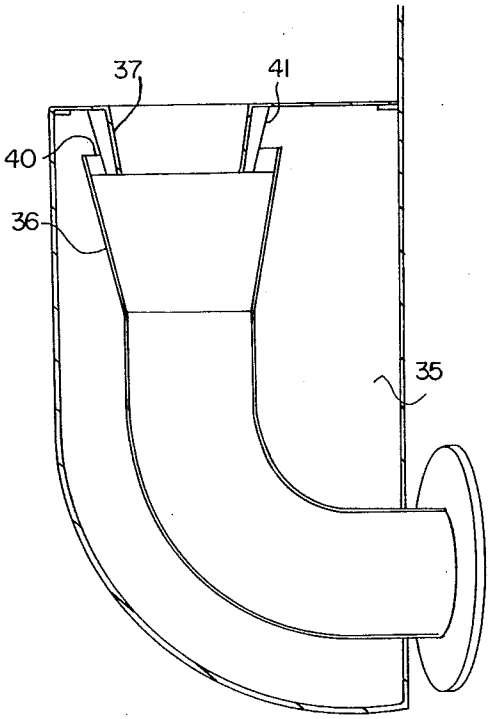
FIG. 9 is an enlarged view showing details of low pressure jet 22.

The first of them is arranged within an enclosed chamber 35 which is adjacent the side wall of the turret 26 and comprises a low pressure jet 22 formed by two truncated cones 36 and 37 of different diameter such that the truncated cone 37 closed at the bottom **37*a* and open at the top is partially housed inside the truncated cone 36 which is open at the top and the bottom in such a way that the side surfaces of truncated cones 36 and 37 are maintained parallel, there being flow divider walls 40 welded perpendicularly to the side wall of member 36, as shown in FIGS. 9 and 10, to minimize the turbulence and vortex. Additional flow divider walls 41 may also be welded to member 37 as shown in FIG. 9 so that they are positioned between walls 40. This arrangement allows the treatment liquor flowing in through the tube 28 from the heat exchanger 19, as may be seen in FIG. 4, to enter enclosed chamber 35 flowing with a great increase in speed through the circular ring formed by the side walls of the two truncated cones 37 and 36 as a result of the reduction in the cross section through which the liquor flows, providing a hydraulic drive force very much superior to that of other overflow devices described in the prior part in which the liquor which flows into a similar chamber 35, but which is open instead of enclosed, overflows freely without any force through the inside of the truncated cone 36**.

The second hydraulic device or means for drawing the fabric is the jet 23, which will not be described because it is a conventional element which has been used in this type of apparatus or similar ones since 1969.

The third hydraulic means for driving the rope is the ring 3 located between the winch 2 and the upper outlet of the chamber 25. Ring 3, as may be seen in FIG. 5, is multiple and is supplied treatment liquor through a curved tube having several portions 3*c*, the elbow 36 and other horizontal portions 3*d* and 3*e* of differing diameters. In the embodiment illustrated in FIG. 5, ring 3 is multiple and is designed for spraying and guiding the fabric in an apparatus having four treatment chambers 25. The inner surface of ring 3 is provided with orifices 3*a* directed downwardly at 45° with respect to the horizontal plane, see FIG. 8, through which the treatment liquor flows under pressure against the rope.

The machine described above and as may be seen from the descriptions and figures hereof, allows a larger number of forced dynamic points of contact between the treatment liquor and the rope fabric.

Having sufficiently described the contents of the present invention in correspondance with the enclosed drawings, it is understood that modifications of detail which are deemed desirable may be made that do not alter the essence of the invention and are within the scope of the following claims.

What I claim is:

1. In a high temperature dyeing apparatus of the type operating in an open chamber on an endless rope of fabric to be dyed, the rope being drawn by mechanical and hydraulic means, the improvement comprising:

a cylindrical body having curved end walls, a top portion and upper sectors on said top portion;

an even number of open treatment and storage chambers within said cylindrical body;

a cylindrical turret on one of said upper sectors;

means on said turret for opening and closing said turret; and a drive winch for driving the endless rope of fabric mounted horizontally in the interior of said turret, said drive winch comprising a cylindrical core, two circular flanges, pairs of rods disposed between said flanges, each rod having an outer side, a cover of non-slip material on said outer side of said rods, and a knurled configuration on said cover material.

2. The apparatus as claimed in claim 1 wherein:

said drive winch has a horizontal axis of rotation; and each rod has ends welded to said flanges, a central portion parallel to said axis of rotation of said drive winch, and respective end portions extending from said central portion at an angle slightly radially outwardly relative to said axis of rotation.

3. In a high temperature dyeing apparatus of the type operating in an open chamber on an endless rope of fabric to be dyed, the rope being drawn by mechanical and hydraulic means, the improvement comprising:

a cylindrical body having curved end walls, a top portion and upper sectors and said top portion;

an even number of open treatment and storage chambers within said cylindrical body;

a cylindrical turret on one of said upper sectors;

means on said turret for opening and closing said turret;

a winch mounted in the interior of said turret so that the rope of fabric passes over said winch;

a plurality of spray rings corresponding to the number of treatment and storage chambers, each spray ring being mounted in said cylindrical body to extend substantially in a horizontal plane between said winch and one of said treatment and storage chambers so that the rope of fabric passes through said spray ring after leaving said one of said treatment and storage chambers and before passing over said winch;

a plurality of orifices in each spary ring directed downwardly at 45° relative to the horizontal plane of the respective spray ring and inwardly relative to the center of the respective spray ring; and a tubular duct connected to sid spray rings for supplying fluid to said spray rings;

said tubular duct comprising a first stright section connected at one end thereof to a first pair of spray rings, a 90° elbow section having one end connected to the other end of said first straight section, a second straight section having one end connected to the other end of said elbow section, a third straight section of larger diameter than said second straight section and having one end connected to the other end of said second straight section, and a fourth straight section connected at one end thereof to said third straight section and at the other end to a second pair of spray rings.

4. In a high temperature dyeing apparatus of the type operating in an open chamber on an endless rope of fabric to be dyed, the rope being drawn by mechanical and hydraulic means, the improvement comprising:

a hollow cylindrical body having a longitudinal axis, curved end walls, a top portion, and upper sectors on said top portion;

a plurality of separate open treatment and storage chambers disposed in adjacent relationship with respect to each other within said cylindrical body, each chamber having a semi-cylindrical lower section with a central axis substantially parallel to said longitudinal axis of said hollow cylindrical body, an upwardly directed outlet section, an upwardly directed inlet section extending substantially higher than said outlet section, and an outer peripheral wall substantially conforming to the shape of the inner surface of said cylindrical body, said treatment and storage chambers being oriented substantially transversely to said longitudinal axis of said hollow cylindrical body to provide a path of travel for the rope of fabric therethrough extending around part of said longitudinal axis of said hollow cylindrical body;

a cylindrical turret on one of said upper sectors;

a drive winch mounted within said turret for rotation on a substantially horizontal axis for driving the endless rope of fabric;

an enclosed cavity at least partly within said turret;

a low pressure jet within said enclosed cavity comprising a first truncated hollow cone having a smaller diameter open end below a larger diameter open end and a substantially vertically extending central axis, a second truncated hollow cone having a smaller diameter open end thereof smaller in diameter than and extending into said larger diameter end of said first truncated cone in spaced relation thereto forming a flow channel therebetween, and a plurality of flow divider walls each having at least one edge thereof welded to one of the surfaces of said truncated cones forming said flow channel and extending into said flow channel between said cones, so that the rope of fabric passes through said truncated cones and fluid passing through said enclosed cavity passes through said flow channel and has the flow rate thereof increased by said flow channel for impinging onto the rope of fabric to provide a hydraulic drive force in the direction of travel of the rope of fabric.

5. The apparatus as claimed in claim 4 and further comprising:

a spray ring mounted on said cylindrical body to extend substantially in a horizontal plane substantially between said winch and said outlet section of at least one treatment and storage chamber so that the rope of fabric passes through said spray ring;

a plurality of orifices in said spray ring directed downwardly at 45° relative to the horizontal plane of said spray ring and inwardly relative to the center of said spray ring; and a tubular duct for supplying fluid to said spray ring comprising a first straight section having one end connected to said spray ring, a 90° elbow section having one end connected to the other end of said first straight section, and a second straight section having one end connected to the other end of said elbow section.

6. The apparatus as claimed in claim 4 wherein:

said lower section of each treatment and storage chamber is substantially semicircumferentially oriented in a vertical plane with respect to said longitudinal axis of said hollow cylindrical body and has a constant rectangular cross section; and said upwardly directed inlet section extends substantially vertically and has a decreasing cross section upwardly.

7. The apparatus as claimed in claim 6 and further comprising:

a spray ring mounted on said cylindrical body to extend substantially in a horizontal plane substantially between said winch and said outlet section of at least one treatment and storage chamber so that the rope of fabric passes through said spray ring;

a plurality of orifices in said spray ring directed downwardly at 45° relative to the horizontal plane of said spray ring and inwardly relative to the center of said spray ring; and a tubular duct for supplying fluid to said spray ring comprising a first straight section having one end connected to said spray ring, a 90° elbow section having one end connected to the other end of said first straight section, and a second straight section having one end connected to the other end of said elbow section.

8. A high temperature dyeing apparatus as claimed in claim 1 and further comprising:

an enclosed cavity at least partly within said turret; and a low pressure jet within said enclosed cavity comprising a first truncated hollow cone having a smaller diameter open end below a larger diameter open end and a substantially vertically extending central axis, a second truncated hollow cone having a smaller diameter open end thereof smaller in diameter than and extending into said larger diameter end of said first truncated cone in spaced relation thereto forming a flow channel therebetween and a plurality of flow divider walls each having at least one edge thereof welded to one of the surfaces of said truncated cones forming said flow channel and extending into said flow channel between said cones, so that the rope of fabric passes through said truncated cones and fluid passing through said enclosed cavity passes through said flow channel and has the flow rate thereof increased by said flow channel for impinging onto the rope of fabric to provide a hydraulic drive force in the direction of travel of the rope fabric.

9. The apparatus as claimed in claim 1 wherein:

said cylindrical body has a longitudinal axis and an inner surface;

said treatment and storage chambers are disposed in adjacent relationship with respect to each other; and each treatment and storage chamber comprises a semi-cylindrical lower section having a central axis substantially parallel to said longitudinal axis of said cylindrical body, an upwardly directed outlet section, an upwardly directed inlet section extending higher than said outlet section, and an outer peripheral wall substantially conforming to the shape of the inner surface of said cylindrical body, said treatment and storage chambers being oriented substantially transversely to said longitudinal axis of said cylindrical body to provide a path of travel for the rope of fabric therethrough extending around part of said longitudinal axis of said cylindrical body.

10. The apparatus as claimed in claim 9 wherein:

said lower section of each treatment and storage chamber is substantially semicircumferentially oriented in a vertical plane with respect to said longitudinal axis of said hollow cylindrical body and has a constant rectangular cross section; and said upwardly directed inlet section extends substantially vertically and has a decreasing cross section upwardly.

11. The apparatus as claimed in claim 10 and further comprising:

a spray ring mounted on said cylindrical body to extend substantially in a horizontal plane substantially between said winch and said outlet section of at least one treatment and storage chamber so that the rope of fabric passes through said spray ring;

a plurality of orifices in said spray ring directed downwardly at 45° relative to the horizontal plane of said spray ring and inwardly relative to the center of said spray ring; and a tubular duct for supplying fluid to said spray ring comprising a first straight section having one end connected to said spray ring, a 90° elbow section having one end connected to the other end of said first straight section, and a second straight section having one end connected to the other end of said elbow section.

12. The apparatus as claimed in claim 9 and further comprising:

a spray ring mounted on said cylindrical body to extend substantially in a horizontal plane substantially between said winch and said outlet section of at least one treatement and storage chamber so that the rope of fabric passes through said spray ring;

a plurality of orifices in said spray ring directed downwardly at 45° relative to the horizontal plane of said spray ring and inwardly relative to the center of said spray ring; and a tubular duct for supplying fluid to said spray ring comprising a first straight section having one end connected to said spray ring, a 90° elbow section having one end connected to the other end of said first straight section, and a second straight section having one end connected to the other end of said elbow section.

* * * * *

UNITED STATES PATENT AND TRADEMARK OFFICE

CERTIFICATE OF CORRECTION

PATENT NO. : 4,881,384

DATED : November 21, 1989

INVENTOR(S) : Mario M. Chicharro

It is certified that error appears in the above-identified patent and that said Letters Patent is hereby corrected as shown below:

On the title page item [73], change "Montaje Y. Construcciones Del Hierro, S.A." to
--Montaje Y Construcciones Del Hierro, S.A., Barcelona, Spain--

Signed and Sealed this

Fourth Day of June, 1991

*Attest:*

HARRY F. MANBECK, JR.

*Attesting Officer*

*Commissioner of Patents and Trademarks*